US006209361B1

(12) United States Patent
Adams

(10) Patent No.: US 6,209,361 B1
(45) Date of Patent: Apr. 3, 2001

(54) YARN-HOLDING APPARATUS FOR A CIRCULAR KNITTING MACHINE

(76) Inventor: Brian Scott Adams, 4414 Spring Meadow Pl., Jamestown, NC (US) 27282

( * ) Notice: Subject to any disclaimer, the term of this patent is extended or adjusted under 35 U.S.C. 154(b) by 0 days.

(21) Appl. No.: 09/654,991

(22) Filed: Sep. 5, 2000

(51) Int. Cl.[7] ..... D04B 35/00
(52) U.S. Cl. ..... 66/145 S; 66/146
(58) Field of Search ..... 66/8, 13, 17, 19, 66/125 R, 145 R, 145 S, 146

(56) References Cited

U.S. PATENT DOCUMENTS 3,077,097 * 2/1963 Butler ..... 66/145
3,079,779 * 3/1963 Butler ..... 66/145
3,222,892 * 12/1965 Moyer ..... 66/145
3,760,608 * 9/1973 Lonati ..... 66/140 S
3,861,177 * 1/1975 Mazzi ..... 66/145 S
3,881,327 * 5/1975 Mahler ..... 66/134
5,031,422 * 7/1991 Plath ..... 66/145 S

FOREIGN PATENT DOCUMENTS

111384 * 7/1964 (CS) ..... 66/140

* cited by examiner

*Primary Examiner*—Danny Worrell

(57) ABSTRACT

An improvement in a yarn-holding apparatus for a circular knitting machine which functions to hold a plurality of yarn ends in the ready position at the air shoe near the machine yarn feeds so that the held yarn ends can be selectively engaged by the yarn feeds and thereafter introduced to the needles of the machine for knitting. An air input station receives air from an airflow source and has a manifold into which the introduced air is directed. A number of air ports are connected with and extend from the manifold thus sending a number of airflow streams into the airflow passage where the yarns are introduced. The directed airflow streams converge to maintain the held yarns in a stationary and tangle-free condition and enable the positive engagement of the yarns by the yarn feeds.

18 Claims, 4 Drawing Sheets

YARN-HOLDING APPARATUS FOR A CIRCULAR KNITTING MACHINE

BACKGROUND OF THE INVENTION

1. Field of the Invention

The present invention relates to an improved yarn-holding apparatus for a circular knitting machine and, more particularly, to an airflow directing device that will direct a plurality of air streams into an airflow passage to engage and maintain a plurality of yarn ends awaiting selection by the yarn feeds of a circular knitting machine.

2. Description of the Prior Art

Conventional multi-feed circular knitting machines need the capability of introducing a number of different yarns at each yarn feed. The yarns are usually presented for engagement at a location within an air stream which holds the yarn ends in a stationary condition as they are selectively engaged by the yarn feeds for knitting. The most commonly used air stream is a conduit or tube into which air is generally injected along the longitudinal axis of the tube. This general flow of air throughout the tube has a tendency to cause the various yarn ends suspended therein to become tangled with each other sometimes resulting in yarn breakage. Broken yarn segments can accumulate within the tube and ultimately affect the air flow thereby causing the machine to cease operation. This results in lost production because of the downtime in cleaning the machine and implementing restart procedures.

This activity will often reoccur in the same machine within a few days or even more often—perhaps more than once during a single shift. With all knitting machines in a plant equipped with this type of yarn-holding mechanism, the entire output of the plant can be adversely impacted by the downtime involved.

Thus it is desirable to improve the yarn-holding mechanism currently in use and provide a more reliable and efficient version that will eliminate costly downtime and increase production. It is to these desirable features that the present invention is directed.

OBJECTIVES AND SUMMARY OF THE INVENTION

The general purpose and objective of the present invention is to provide an improved yarn-holding apparatus for a circular knitting machine which has all, and more, of the advantages of prior art devices and none of the disadvantages.

It is another feature and objective of the present invention to provide a yarn-holding apparatus for a circular knitting machine that will drastically reduce and perhaps totally eliminate downtime associated with machine termination when yarn faults occur.

Yet another objective of the present invention is to provide an improvement of the type described that is easily adaptable to conventional knitting machines without costly machine modifications and extensive installation time.

Yet still a further objective of the present invention is to provide an improvement of the type described that will use the existing air source currently available in conventional machines without any change in the equipment providing that air source.

A further objective of the present invention is to provide an improvement of the type described that will more positively control the flow of yarn fed to the knitting machines.

Still another objective of the present invention is to provide an improvement of the type described that will reduce the amount of manpower necessary to keep a knitting facility in continuous operation.

From the foregoing objectives, it can be seen that the present invention is an improvement in the yarn-holding apparatus for a circular knitting machine of the type in which a plurality of yarns are held by air flow for selective engagement by the yarn feeds and movement of the yarns to the needles of the knitting machine. The improvement is an air input station which receives air from an airflow source and directs it into an airflow passage. The station contains an encircling manifold from which extends a plurality of air ports into the airflow passage. The airflow ports connected to the manifold direct a plurality of airflow streams in a manner that causes the streams to intersect proximate the center of the airflow passage and maintain the held yarns in a stationary and tangle-free condition prior to being engaged by the yarn feeds and fed to the knitting machine needles. This directed plural air stream flow has a positive effect on the plurality of yarns held. The airflow ports direct the air stream into the airflow passage at an angle of about 45 degrees with the longitudinal axis of the passage. The airflow ports are positioned around the circumference of the airflow passage engaging member, and a satisfactory range for the number of ports to be utilized is from 4 to 10. In practice, one air input station can service two separate yarn feed stations.

The objectives and summary focus on the more important features of the invention in order that the detailed description which follows may be better understood and that the present contribution to the art may be better appreciated. There are, of course, additional features of the invention that will be described hereinafter and which will form the subject matter of the claims appended hereto. It is to be understood that the invention is not limited to the details of construction and to the arrangement of components set forth in the following description and illustrated in the drawings. The invention is capable of other embodiments and of being practiced and carried out in various ways.

It is also to be understood that the phraseology and terminology employed herein are for the purpose of description and should not be regarded as limiting in any respect. Those skilled in the art will appreciate that the concept upon which this disclosure is based may readily be utilized as a basis for designing other structures, methods and systems for carrying out the several purposes of this development. It is also to be understood that the abstract is neither intended to define the invention of application, which is measured by its claims, nor to limit its scope in any way.

This summary and these objects of the invention, along with the various features which characterize the invention, are noted with particularity in the claims annexed to and forming a part of this disclosure. For a better understanding of the invention, its operating advantages and the specific results obtained by its use, reference should be made to the following detailed specification taken in conjunction with the accompanying drawings wherein like characters of reference designate like parts throughout the several views.

DETAILED DESCRIPTION OF THE PREFERRED EMBODIMENT

Figure 1:
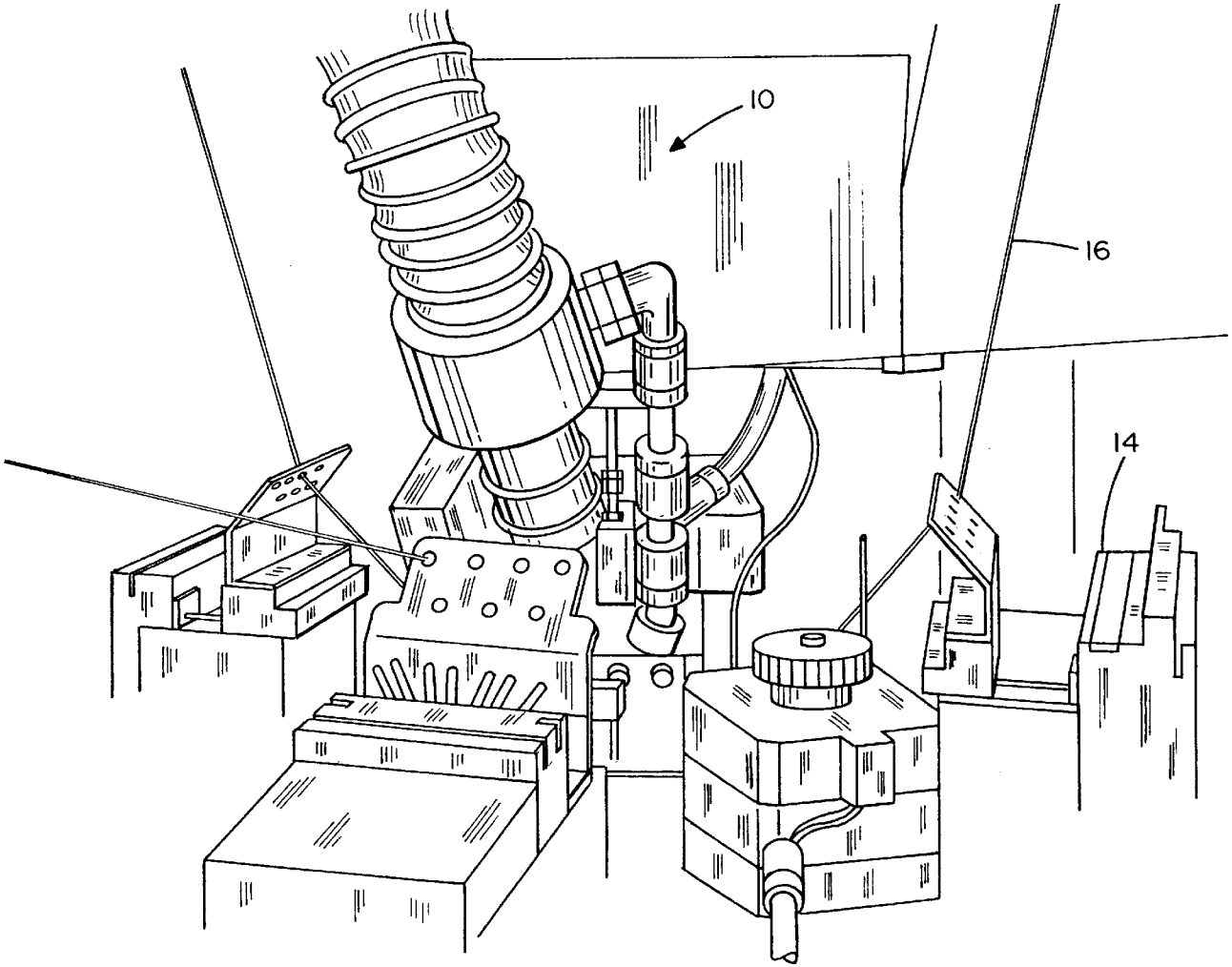
FIG. 1 is a perspective and partial view of the top of a multi-feed circular knitting machine showing the improvement of the present invention positioned between an air flow source and the air flow passage formed by flexible tubing.

Referring now to the drawings and particularly to FIG. 1, a conventional circular knitting machine shown generally as 10 utilizes a plurality of feed stations, one of which is shown and designated 12. Because of the many different types of yarn used in any particular garment being knit on such a machine, a plurality of yarn feeds 14 are utilized at each yarn feed station 12. Yarns as such as that shown as 16 extend downwardly to the machine from a holding or dispensing creel, and the yarn ends must be positioned at a convenient location near feeds 14 so that the needed yarn can be engaged by the appropriate feed 14 and introduced to the knitting needles (not shown) at the appropriate time.

Figure 2:
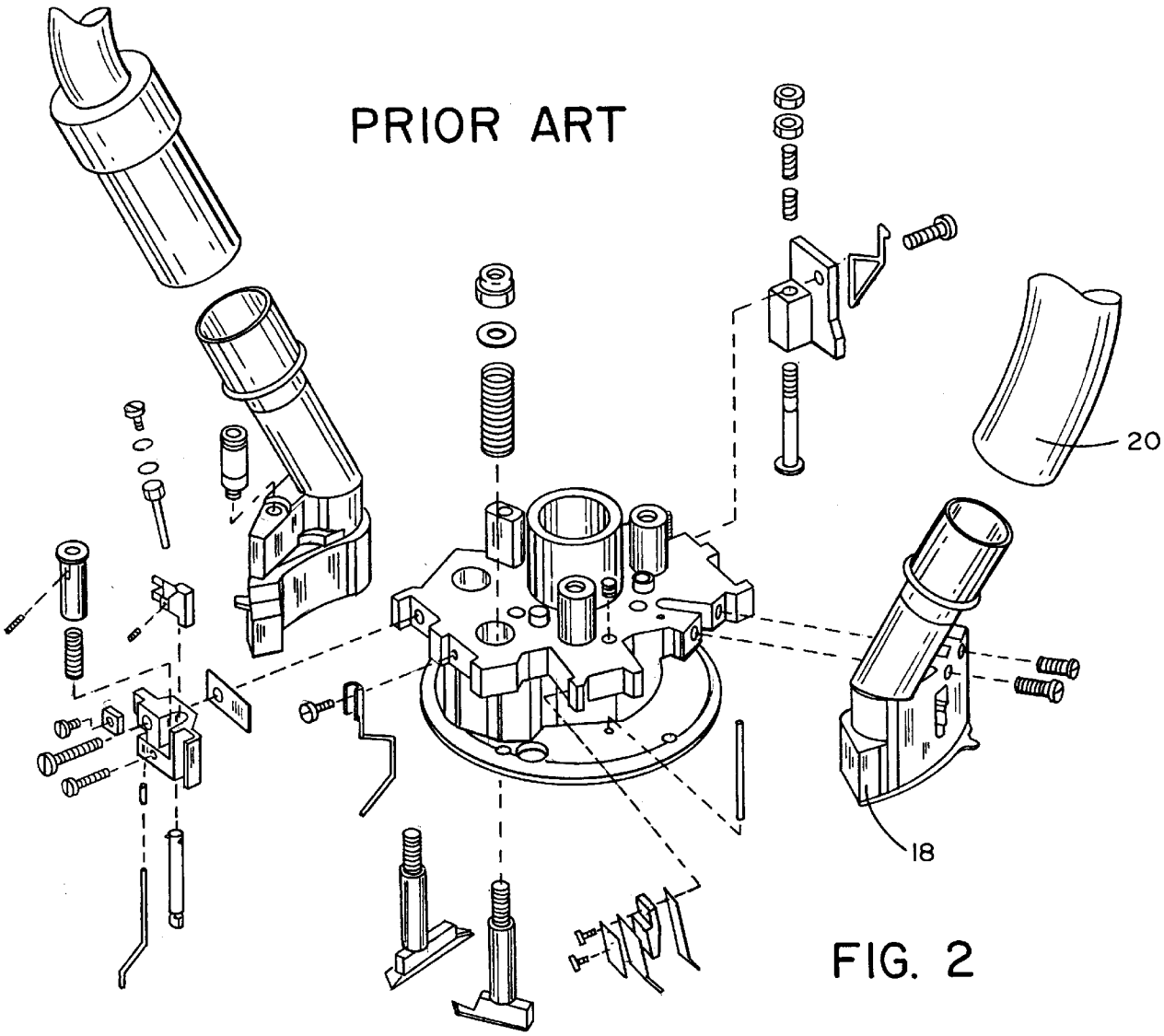
FIG. 2 is an exploded view of the components associated with the top of a circular knitting machine utilizing a conventional yarn holding device constituting prior art.
Figure 3:
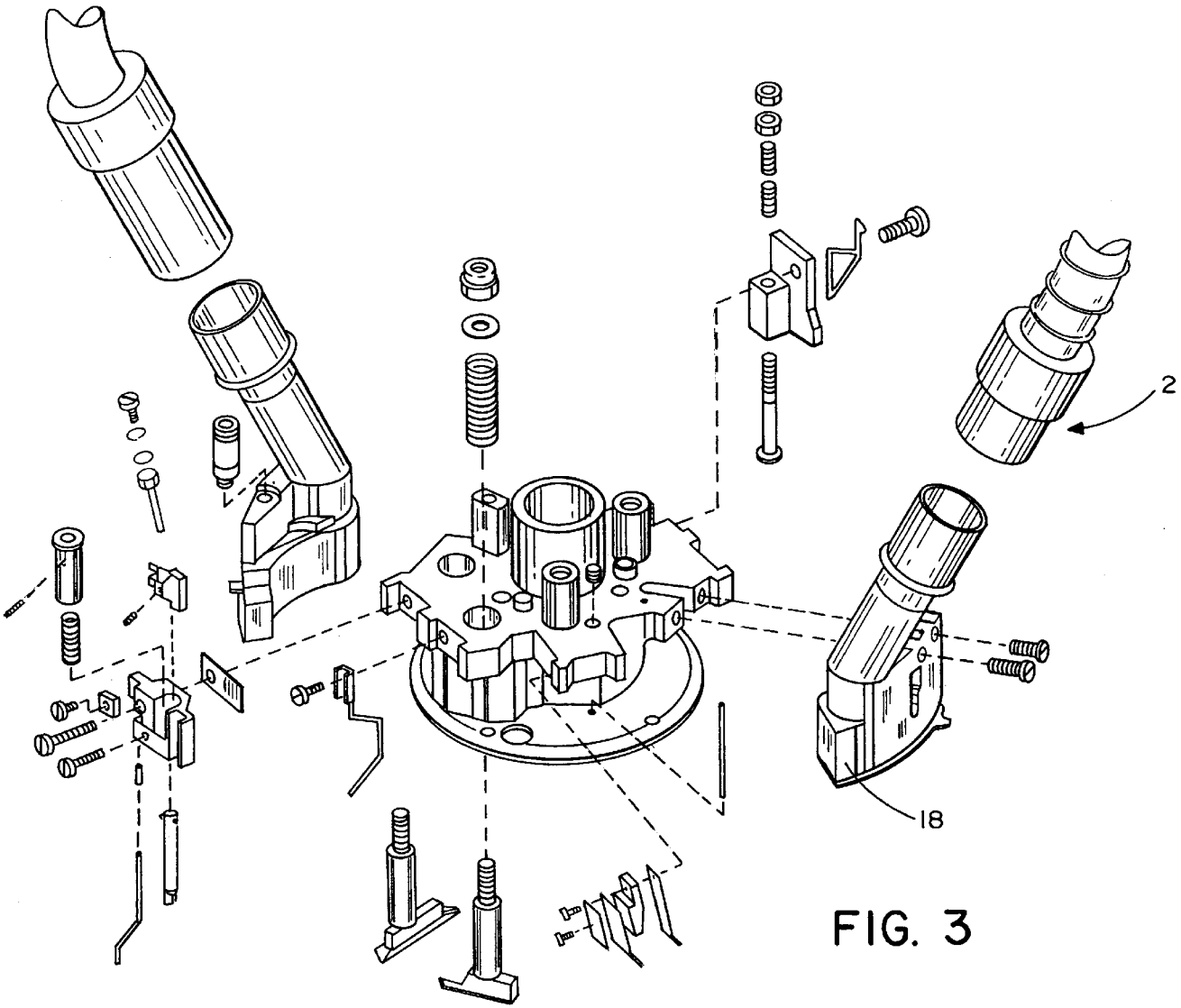
FIG. 3 is an exploded view of the components associated with the top of a circular knitting machine which include the improvement of the present invention.
Figure 5:
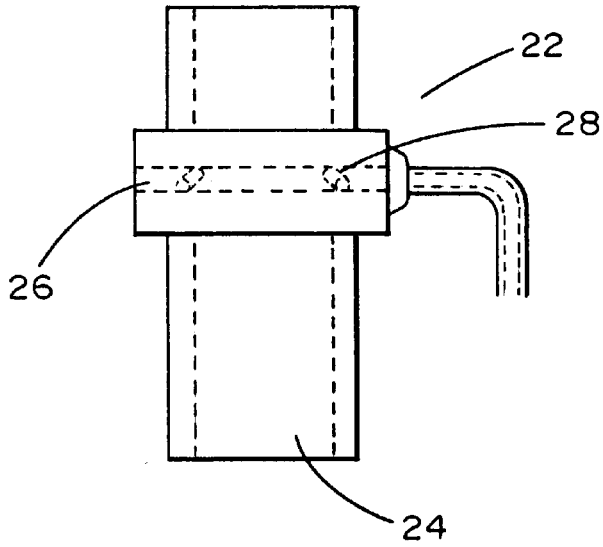
FIG. 5 is a side elevational and sectional view of the improvement comprising the present invention also showing the air flow ports and feeding manifold.

The yarn ends are commonly positioned within an air shoe 18 with air flow influencing that component and moving up through conduit 20. The general air flow that induces place through shoe 18 and into conduit 20 is sensitive to any impediments to such flow that occur within the conduit. In conventional equipment such as shown in FIG. 2, the plurality of yarn ends held within air shoe 18 often become entangled and sometimes break thus leaving yarn segments to flow into conduit 20 and interfere with the air flow occurring therein. That interference can reduce the beneficial effect of the air flow and cause the yarn ends to withdraw or be inappropriately positioned ultimately resulting in machine stoppage when the yarn feed attempts to engage a yarn end to bring it to the knitting needles and the yarn end is not available because it has been displaced.

The present invention addresses this deficiency by providing an air input station shown generally as 22 which has an airflow passage engaging member 24 in an air input device 26. Air input station 24 substantially encircles airflow passage 21 and includes an airflow receiving manifold 26. Airflow passage engaging member 24 has a plurality of air ports 28 that connect with and extend from manifold 26 to direct a plurality of airflow streams 30 from manifold 26 through ports 28 and into airflow passage 21.

Figure 6:
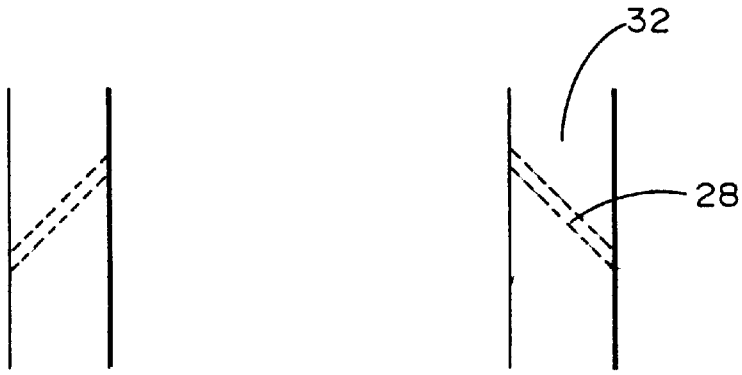
FIG. 6 is an enlarged fragmentary and sectional view of the air flow passage engaging member showing the placement of air ports within the member's walls.

Air ports 28 are drilled in walls 32 of improvement 22 so as to direct airflow into the airflow passage at an angle of approximately 45 degrees to the longitudinal axis of airflow passage 21. This relationship is best illustrated in FIG. 6.

Figure 4:
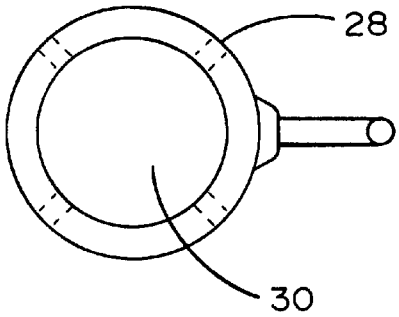
FIG. 4 is a top plan view of the improvement of the present invention illustrating an acceptable arrangement of the air flow ports suitable for holding a plurality of yarn ends in a stationary and tangle-free condition prior to being fed to the knitting machine needles.

Since all air ports 28 are inclined at a 45 degree angle to the longitudinal axis of air flow passage 21, the air streams associated therewith intersect proximate the center of air flow passage 21 (FIG. 4). The intersecting air streams at this location has a very positive effect on the yarn ends extending in through air shoe 18, holding them in a stationary and tangle-free condition until they are selectively engaged by a yarn feed 14 for introduction to the knitting machine needles.

The number of air ports 28 utilized for effective yarn management ranges from 4 to 10 with 4 air ports being quite efficient to accomplish the desired objective. Different yarn sizes and weights could necessitate the use of additional ports, however no more than 10 has been found necessary under any circumstances or other varying conditions.

From the proceeding description, it can be seen that a yarn-holding attachment improvement for a circular knitting machine has been provided that will meet all of the advantages of prior art devices and offer additional advantages not heretofore achievable. With respect to the foregoing invention, the optimum dimensional relationship to the parts of the invention including variations in size, materials, shape, form, function, and manner of operation, use and assembly are deemed readily apparent to those skilled in the art, and all equivalent relationships illustrated in the drawings and described in the specification are intended to be encompassed herein.

The foregoing is considered as illustrative only of the principles of the invention. Numerous modifications and changes will readily occur to those skilled in the art, and it is not desired to limit the invention to the exact construction and operation shown and described. All suitable modifications and equivalents that fall within the scope of the appended claims are deemed within the present inventive concept.

What is claimed is:

1. An improved yarn-holding apparatus for a circular knitting machine of the type in which a plurality of yarns are being held by airflow from an airflow source for feeding to the needles of the knitting machine proximate the air shoe in an airflow passage, wherein the improvement comprises: an air input station receiving air from the airflow source and connecting with the airflow passage; an airflow receiving manifold within the air input station; and a plurality of air ports connecting with and extending from the manifold to direct a plurality of airflow streams from the manifold upwardly and inwardly into the airflow passage to maintain the held yarns in a stationary and tangle-free condition within the airflow passage prior to being fed to the knitting machine needles.

2. The improvement as claimed in claim 1 wherein the air ports are formed to direct airflow into the airflow passage at an angle of approximately 45 degrees.

3. The improvement as claimed in claim 1 wherein the air input station further includes an airflow passage engaging member and an air input device introducing air into the manifold.

4. The improvement as claimed in claim 1 wherein the manifold is a passageway within the air input station substantially encircling the airflow passage.

5. The improvement as claimed in claim 1 wherein the number of air ports are within the range of from 4 to 10.

6. The improvement as claimed in claim 1 wherein the plurality of airflow streams directed from the air ports intersect proximate the center of the airflow passage.

7. The improvement as claimed in claim 3 wherein the manifold is a passageway within the air input station substantially encircling the airflow passage.

8. The improvement as claimed in claim 3 wherein the number of air ports are within the range of from 4 to 10.

9. The improvement as claimed in claim 4 wherein the number of air ports are within the range of from 4 to 10.

10. The improvement as claimed in claim 7 wherein the air ports are formed to direct airflow into the airflow passage at an angle of approximately 45 degrees.

11. The improvement as claimed in claim 8 wherein the air ports are formed to direct airflow into the airflow passage at an angle of approximately 45 degrees.

12. The improvement as claimed in claim 9 wherein the air ports are formed to direct airflow into the airflow passage at an angle of approximately 45 degrees.

13. The improvement as claimed in claim 6 wherein the air ports are formed to direct airflow into the airflow passage at an angle of approximately 45 degrees.

14. The improvement as claimed in claim 7 wherein the plurality of airflow streams directed from the air ports intersect proximate the center of the airflow passage.

15. The improvement as claimed in claim 8 wherein the plurality of airflow streams directed from the air ports intersect proximate the center of the airflow passage.

16. The improvement as claimed in claim 9 wherein the plurality of airflow streams directed from the air ports intersect proximate the center of the airflow passage.

17. An improved yarn-holding apparatus for a circular knitting machine of the type for which a plurality of yarns are being held by airflow from an airflow source for feeding to the needles of the knitting machine proximate the airflow in an airflow passage, wherein the improvement comprises: an air input station receiving air from the airflow source and connecting with the airflow passage; an airflow receiving manifold within the air input station; and a plurality of air ports connecting with and extending from the manifold to direct a plurality of airflow streams from the manifold into the airflow passage to maintain the held yarns in a stationary tangle-free condit8ion within the airflow passage prior to being fed to the knitting machine needles wherein the air input station further includes an airflow passage engaging member and an air input device introducing air into the manifold, the manifold is a passageway within the air input station substantially encircling the airflow passage, and the plurality of airflow streams directed from the air ports intersect proximate the center of the airflow passage.

18. The improvement as claimed in claim 17 wherein the airflow passage engaging member encircles the air flow passage and the plurality of air ports are selectively positioned about the encircling engaging member.

* * * * *